US012405016B1

(12) United States Patent
Nurenberg et al.

(10) Patent No.: US 12,405,016 B1
(45) Date of Patent: Sep. 2, 2025

(54) GABLE VENT ASSEMBLY WITH OFFSET LOCK

(71) Applicant: Westlake Royal Building Products (USA) Inc., Houston, TX (US)

(72) Inventors: Aundrea Nurenberg, Metamora, MI (US); Christopher Miller, Metamora, MI (US); Nathan Greenway, Metamora, MI (US); Adam Clark, Grand Blanc, MI (US)

(73) Assignee: WESTLAKE ROYAL BUILDING PRODUCTS (USA) INC., Houston, TX (US)

( * ) Notice: Subject to any disclaimer, the term of this patent is extended or adjusted under 35 U.S.C. 154(b) by 0 days.

(21) Appl. No.: 18/940,770

(22) Filed: Nov. 7, 2024

(51) Int. Cl.
*F24F 7/02* (2006.01)

(52) U.S. Cl.
CPC ..... *F24F 7/02* (2013.01)

(58) Field of Classification Search
CPC ..... F24F 7/02; F24F 13/082
See application file for complete search history.

(56) References Cited

U.S. PATENT DOCUMENTS 8,205,401 B2 * 6/2012 Ward ..... F24F 7/02 52/302.1
10,415,252 B1 * 9/2019 Polston ..... F24F 7/02
12,163,336 B2 * 12/2024 Maurer ..... E04F 13/076

* cited by examiner

*Primary Examiner* — Allen R. B. Schult
(74) *Attorney, Agent, or Firm* — Polsinelli PC

(57) ABSTRACT

A gable vent assembly has a base that mates and locks with a cover having vents in a first position when locks of the base and cover are aligned with one another to lock together. The cover and base nest together in a second unlocked position when the cover is rotated relative to the base so that locks of the base and cover are not aligned and cannot lock together.

8 Claims, 12 Drawing Sheets

GABLE VENT ASSEMBLY WITH OFFSET LOCK

BACKGROUND OF THE INVENTION

The present invention relates to airflow devices installed on attic walls, including gable vent assemblies. A gable vent assembly may include a base portion with airflow openings and a cover portion with vents. A cover portion may have a decorative shape, such a square, rectangular, octagonal, and other geometric shapes.

Often storage, transport and shipping of gable assemblies can present a challenge since the two pieces of a base and cover of the assembly can take up considerable space when packed on top of one another. There is therefore a need for a gable assembly that can be packed to take up less space for storage and transport, such as nesting together, while the base and cover can be readily removed from the packed positions and moved into an installation and use position in which the base and cover can be locked to one another when installed in an attic wall. Further, there is a need for a base and cover of a gable assembly to selectively be unlocked when packed or nested and then the base and cover be able to be locked together when installed after being more easily removed from the packed and unlocked configuration..

SUMMARY OF THE INVENTION

To address these needs, in aspects, the technologies described herein relate to a gable vent assembly including: a base including a bottom surface with a plurality of openings; a first base side surface extending outward from the bottom surface, wherein the first base side surface includes a first end of the first base side surface and a second end of the first base side surface, and wherein the first base side surface further includes a first base lock located a first base length from the first end of the first base side surface and a second base lock located a second base length from the second end of the first base side surface, and wherein the first base length has a different measurement from the second base length; a second base side surface opposite the first base side surface extending outward from the bottom surface, wherein the second base side surface includes a first end of the second base side surface and second end of the second base side surface, and wherein the second base side surface further includes a third base lock located a third base length from the first end of the second base side surface and a fourth base lock located a fourth base length from the second end of the second base side surface, and wherein the third base length has a different measurement from the fourth base length; a cover including a plurality of vents between a first cover side surface and a second cover side surface opposite the first cover side surface, wherein the first cover side surface includes a first end of the first cover side surface and a second end of the first cover side surface, and wherein the first cover side surface further includes a first cover lock located a first cover length from the first end of the first cover side surface and a second cover lock located a second cover length from the second end of the first cover side surface, and wherein the first cover length has a different measurement from the second cover length; a second cover side surface opposite the first cover side surface, wherein the second cover side surface includes a first end of the second cover side surface and a second end of the second cover side surface, and wherein the second cover side surface further includes a third cover lock located a third cover length from the first end of the second cover side surface and a fourth cover lock located a fourth cover length from the second end of the second cover side surface, and wherein the third cover length has a different measurement from the fourth cover length; and in a first mating position between the base and the cover, the first base lock couples to the first cover lock, the second base lock couples to second cover lock, the third base lock couples to the third cover lock, and the fourth base lock couples to the fourth cover lock.

In some aspects, the technologies described herein relate to a gable vent assembly, wherein in a second mating position with the cover rotated 180 degrees from the second mating position, the base and cover nest together without any of the locks coupling to one another.

In some aspects, the technologies described herein relate to a gable vent assembly, wherein the locks that couple together are configured to secure together to provide adjustable distance between the bottom surface of the base and the plurality of vents of the cover.

In some aspects, the technologies described herein relate to a gable vent assembly, wherein at least one lock of a pair of locks that couple together include locking teeth.

In some aspects, the technologies described herein relate to a gable vent assembly, wherein at least one lock of a pair of locks that couple together includes a locking projection that engage the locking teeth of the other lock of the pair of locks.

In some aspects, the technologies described herein relate to a gable vent assembly, wherein the cover is a rectangle or square.

In some aspects, the technologies described herein relate to a gable vent assembly, wherein the cover is a rectangle or square.

In some aspects, the technologies described herein relate to a gable vent assembly, the cover is a rectangle or square.

In some aspects, the technologies described herein relate to a gable vent assembly, wherein the cover is a rectangle or square.

In some aspects, the technologies described herein relate to a gable vent assembly, wherein the cover is a rectangle or square.

In some aspects, the technologies described herein relate to a gable vent assembly including a base having a bottom surface with openings and the base including a plurality of base locks; and a cover having vents and the cover including a plurality of cover locks, wherein the plurality of base locks align with the plurality of cover locks and securely couple the base to the cover in a first mating position, and wherein the cover is configured to be rotated to a second mating position with the cover and base nesting together without the plurality of base locks coupling to the plurality of cover locks.

In some aspects, the technologies described herein relate to a gable vent assembly wherein the cover and base each include side surfaces in an octagon shape.

In some aspects, the technologies described herein relate to a gable vent assembly wherein the cover and base each include side surfaces in a square shape.

In some aspects, the technologies described herein relate to a gable vent assembly wherein the cover and base each include side surfaces in a rectangle shape.

In some aspects, the technologies described herein relate to a gable vent assembly, wherein the cover is configured to rotate 180 degrees from the first mating position to the second mating position.

In some aspects, the technologies described herein relate to a gable vent assembly, wherein the cover rotates 180 degrees from the first mating position to the second mating position.

In some aspects, the technologies described herein relate to a gable vent assembly, wherein the base locks and cover locks are configured to lock the base and cover at different distances between the bottom surface of the base and the vents of the cover.

In some aspects, the technologies described herein relate to a gable vent assembly, wherein the base locks and cover locks are configured to lock the base and cover at different distances between the bottom surface of the base and the vents of the cover.

In some aspects, the technologies described herein relate to a gable vent assembly, wherein the base locks and cover locks are configured to lock the base and cover at different distances between the bottom surface of the base and the vents of the cover.

In some aspects, the technologies described herein relate to a gable vent assembly, wherein the base locks and cover locks are configured to lock the base and cover at different distances between the bottom surface of the base and the vents of the cover.

DETAILED DESCRIPTION OF THE INVENTION

The following elements are described herein with reference to the corresponding reference designations:

| ELEMENT | REFERENCE |
|---|---|
| Gable Vent Assembly | 100 |
| Base | 110 |
| Base Bottom Surface | 115 |
| Bottm Surface Openings | 117 |
| First Base Side Surface | 122 |
| Second Base Side Surface | 124 |
| Base Fastening Flange | 126 |
| Fastener Opening | 128 |
| First End of the First Base Side Surface | 130 |
| Second End of the First Base Side Surface | 132 |
| First Base Length | 134 |
| Second Base Length | 136 |
| First End of Second Base Side Surface | 140 |
| Second End of Second Base Side Surface | 142 |
| Third Base Length | 144 |
| Fourth Base Length | 146 |
| Locks | 150 |
| First Base Lock | 150a |
| Second Base Lock | 150b |
| Third Base Lock | 150c |
| Fourth Base Lock | 150d |
| First Cover Lock | 150e |
| Second Cover Lock | 150f |
| Third Cover Lock | 150g |
| Fourth Cover Lock | 150h |
| Locking Teeth | 152 |
| Locking Projection | 154 |
| Cover | 160 |
| Cover Vents | 165 |
| First Cover Side Surface | 172 |
| Second Cover Side Surface | 174 |
| First End of First Cover Side Surface | 180 |
| Second End of First Cover Side Surface | 182 |
| First Cover Length | 184 |
| Second Cover Length | 186 |
| First End of Second Cover Side Surface | 190 |
| Second End of Second Cover Side Surface | 192 |
| Third Cover Length | 194 |
| Fourth Cover Length | 196 |

Figure 1:
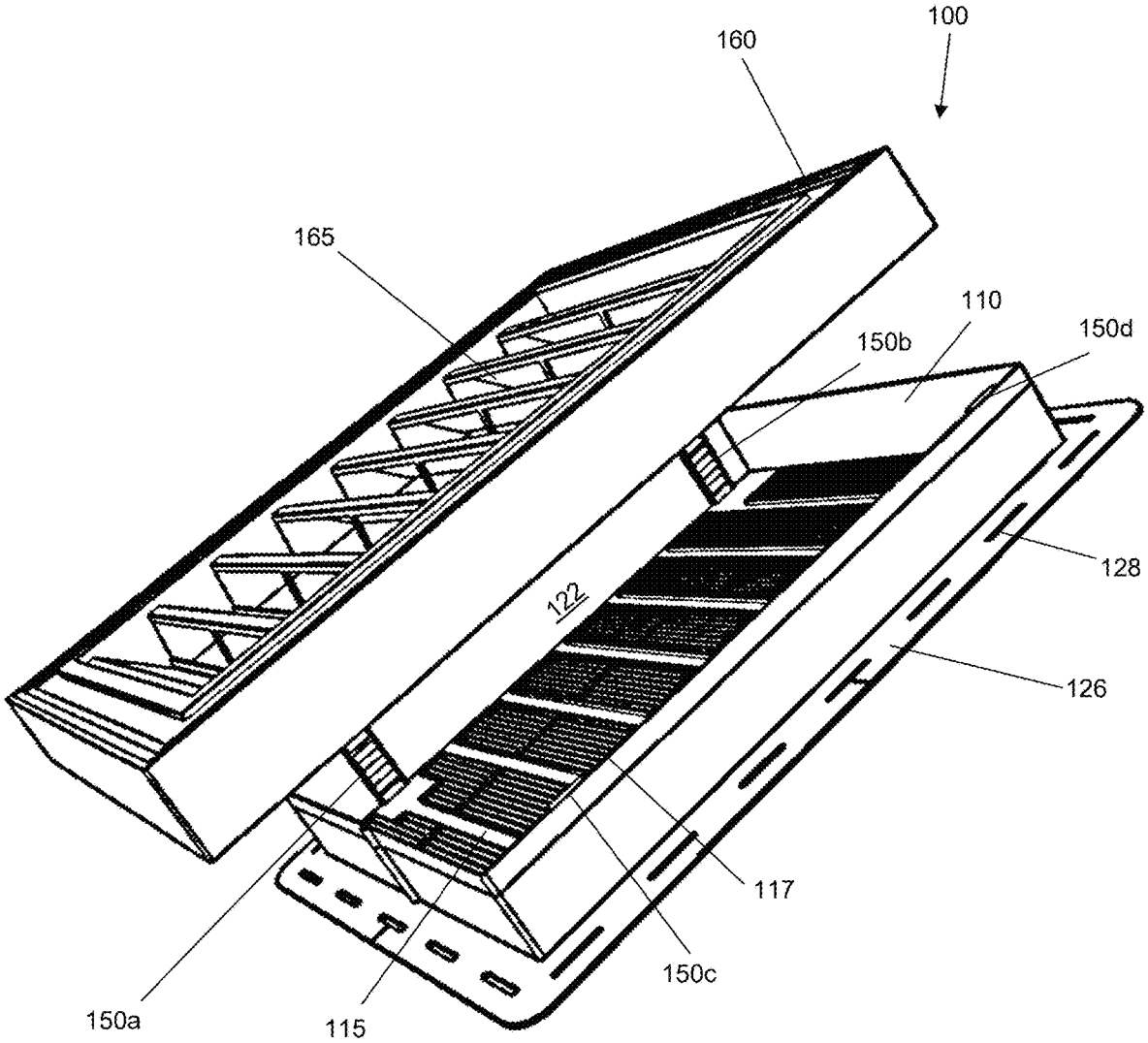
FIG. 1 is an assembly view from above of a gable vent assembly including a base and cover in one embodiment of the invention.
Figure 2:
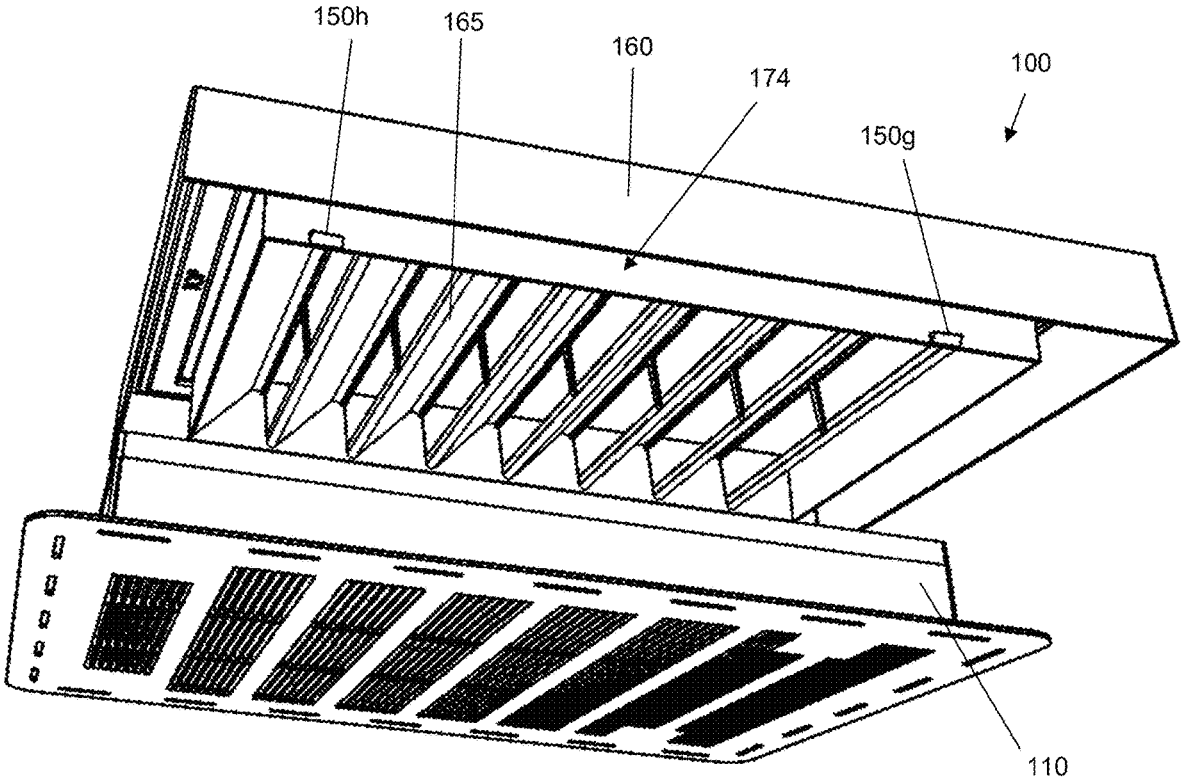
FIG. 2 is an assembly view from below of a gale vent assembly including a base and cover in one embodiment of the invention.

Referring to FIGS. 1 and 2, a gable vent assembly 100 includes a cover 160 with vents 165 that couples to a base 110. The cover 160 may include numerous decorative shapes, such as a square (not shown), rectangle (shown in FIGS. 1-7, 11 and 12), octagon (shown in FIGS. 8-10), other polygons, circles, rounded and oval shapes, and a variety of other symmetrical and non-symmetrical geometries. The base 110 can have a similar or nearly similar shape to the cover 160 or can have a different shape in some embodiments that still permit coupling of the base 110 and cover 160, while the cover 160 only has the desired shape since the base 110 is hidden when installed. A decorative cover 160 and vents 165 is secured to the base 110 facing outward on an exterior of an attic wall. The base 110, such as including a fastening flange 126 with fastener openings 128 as shown in FIG. 3, is fastened to the interior of an attic wall so that airflow can pass though the gable vent assembly between the cover 160 at the exterior of the attic wall and then through openings 117 in a bottom surface 115 of the base that faces into the interior of an attic.

Figure 3:
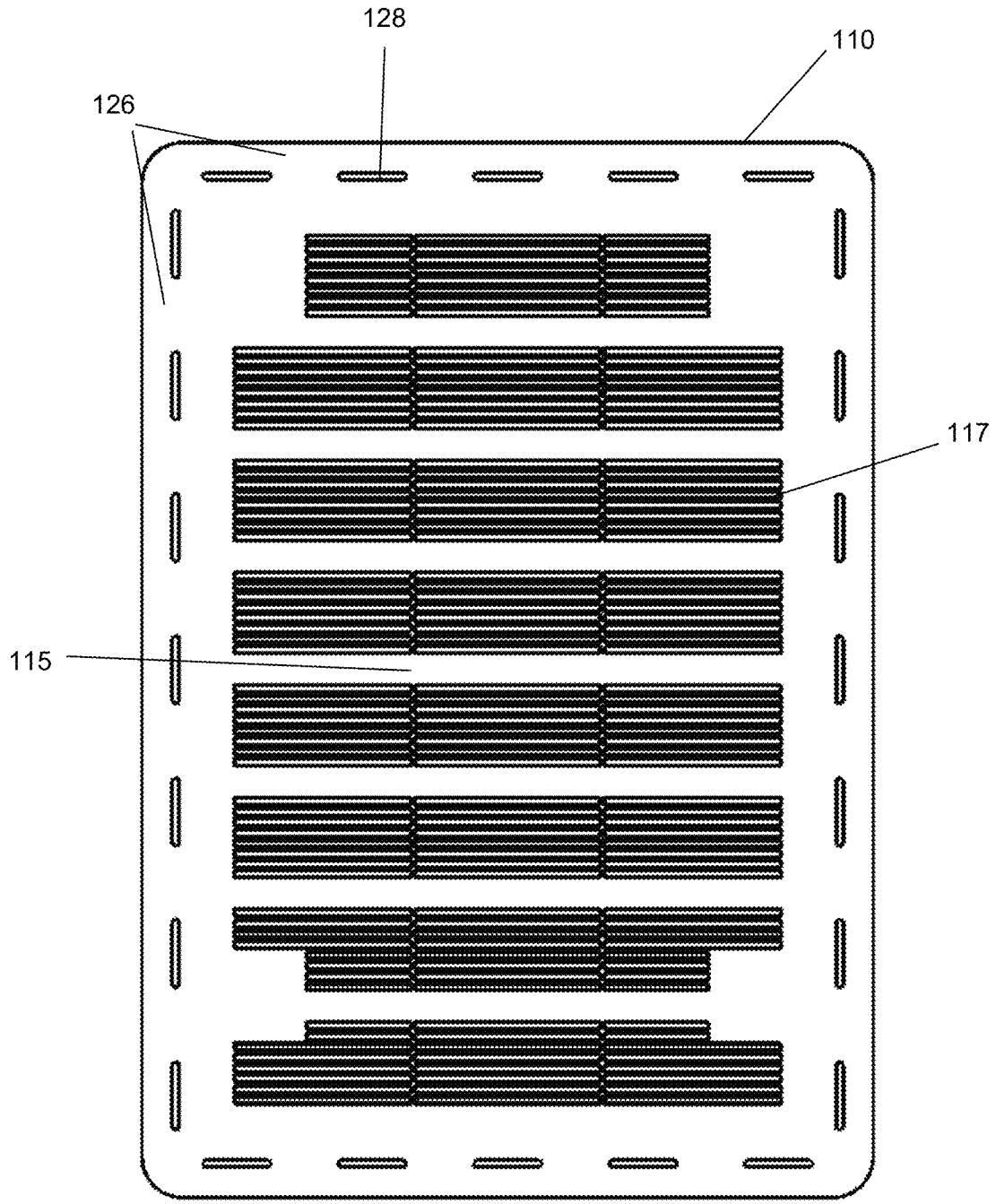
FIG. 3 is a bottom plan view of a base of a gable vent assembly in one embodiment of the invention.
Figure 4:
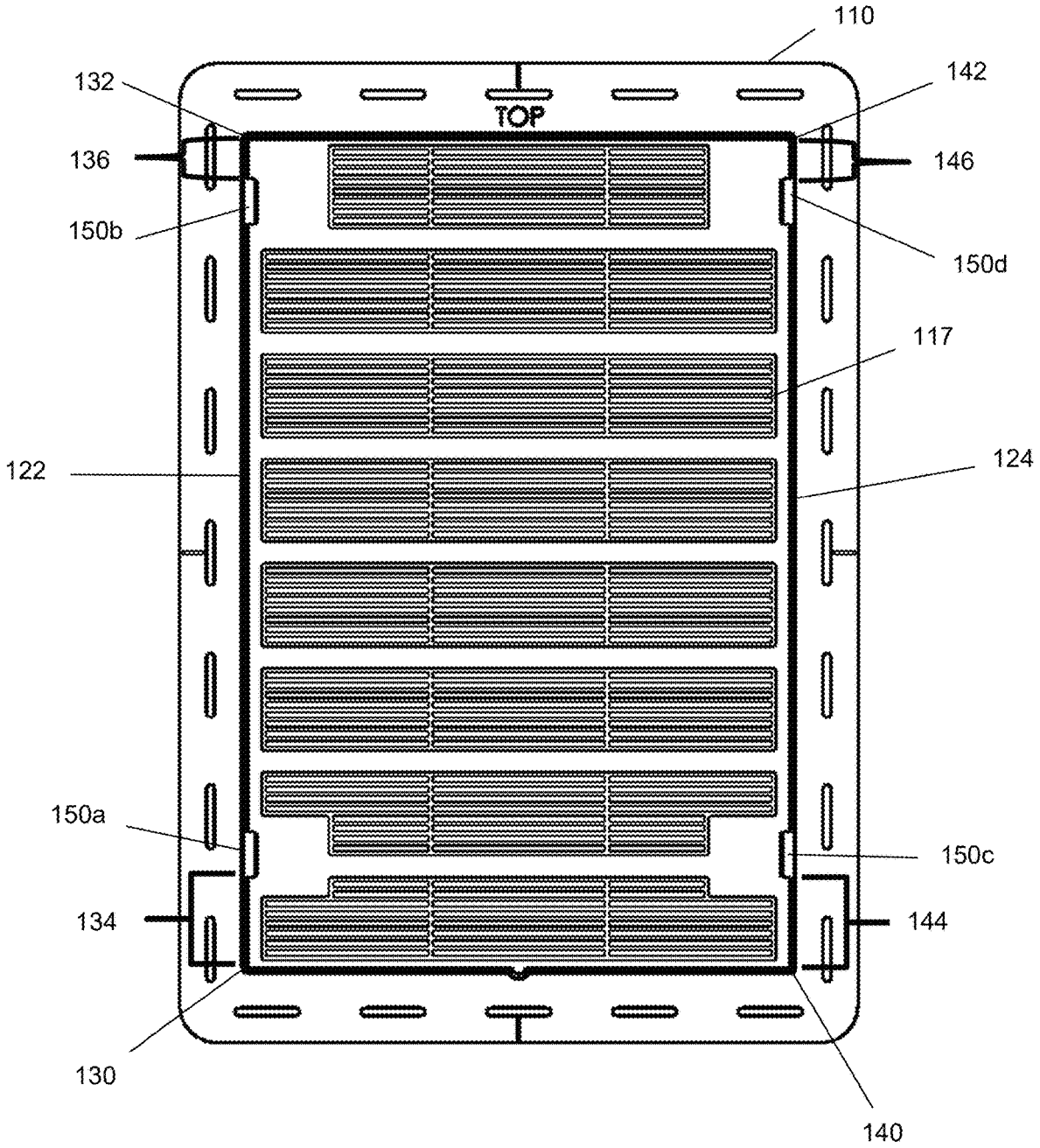
FIG. 4 i is a top plan view of a base of a gable vent assembly in one embodiment of the invention.

With further reference to FIGS. 3 and 4, the base 110 includes a bottom surface 115 with a plurality of openings 117. A first base side surface 122 extends outward from the bottom surface 115. The first base side surface 122 includes a first end 130 of the first base side surface and a second end 132 of the first base side surface, The first base side surface 122 further includes a first base lock 150*a* located a first base length 134 from the first end 130 of the first base side surface and a second base lock 150*b* located a second base length 136 from the second end 132 of the first base side surface, To permit rotation or other movement of the cover and base from a mating position of nesting in an unlocked position during packaging to another mating position of being coupled and locked together when installed in an attic wall, the first base length 134 has a different measurement from the second base length 136.

The base 110 also includes a second base side surface 124 opposite the first base side surface 122 extending outward from the bottom surface 115, The second base side surface 124 includes a first end 140 of the second base side surface and second end 142 of the second base side surface. The second base side surface 124 further includes a third base lock 150*c* located a third base length 144 from the first end 140 of the second base side surface and a fourth base lock 150*d* located a fourth base length 146 from the second end 142 of the second base side surface. To permit rotation or other movement of the cover and base from a mating position of nesting in an unlocked position during packaging to another mating position of being coupled and locked together when installed in an attic wall, the third base length 144 has a different measurement from the fourth base length 146.

Figure 5:
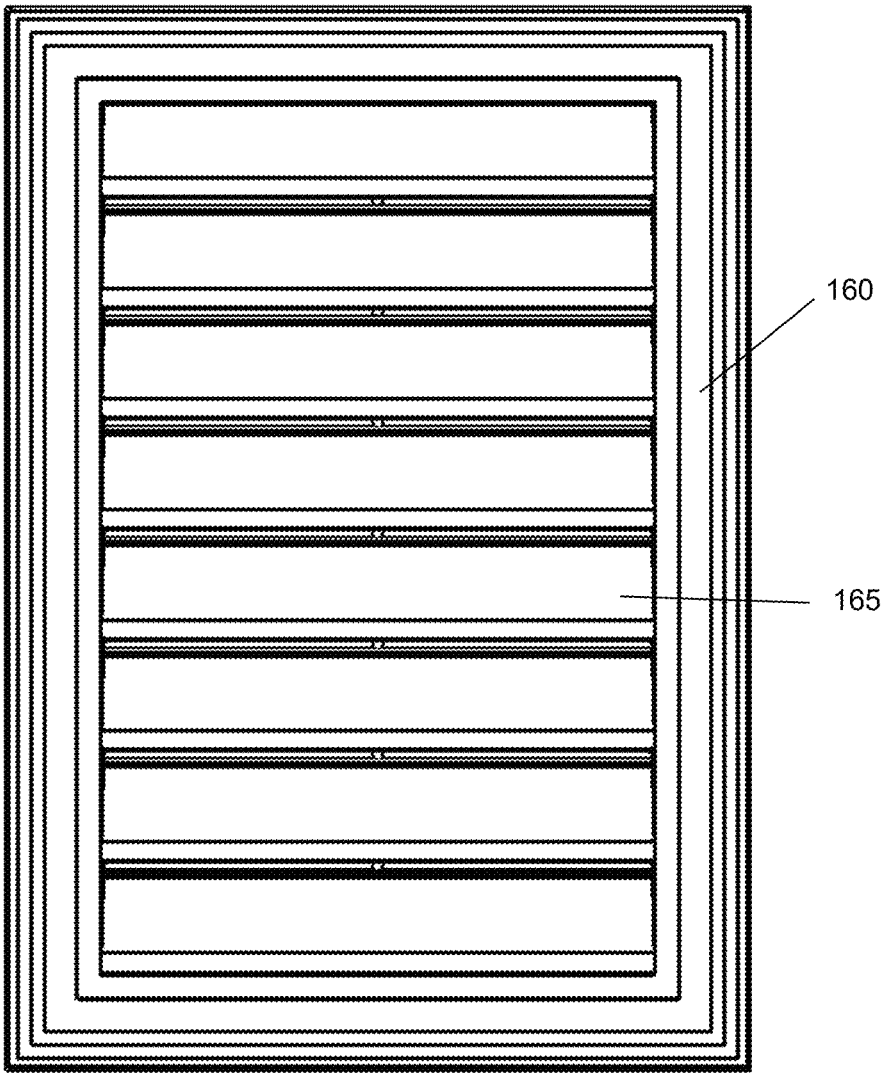
FIG. 5 is a bottom plan view of a cover of a gable vent assembly in one embodiment of the invention.
Figure 6:
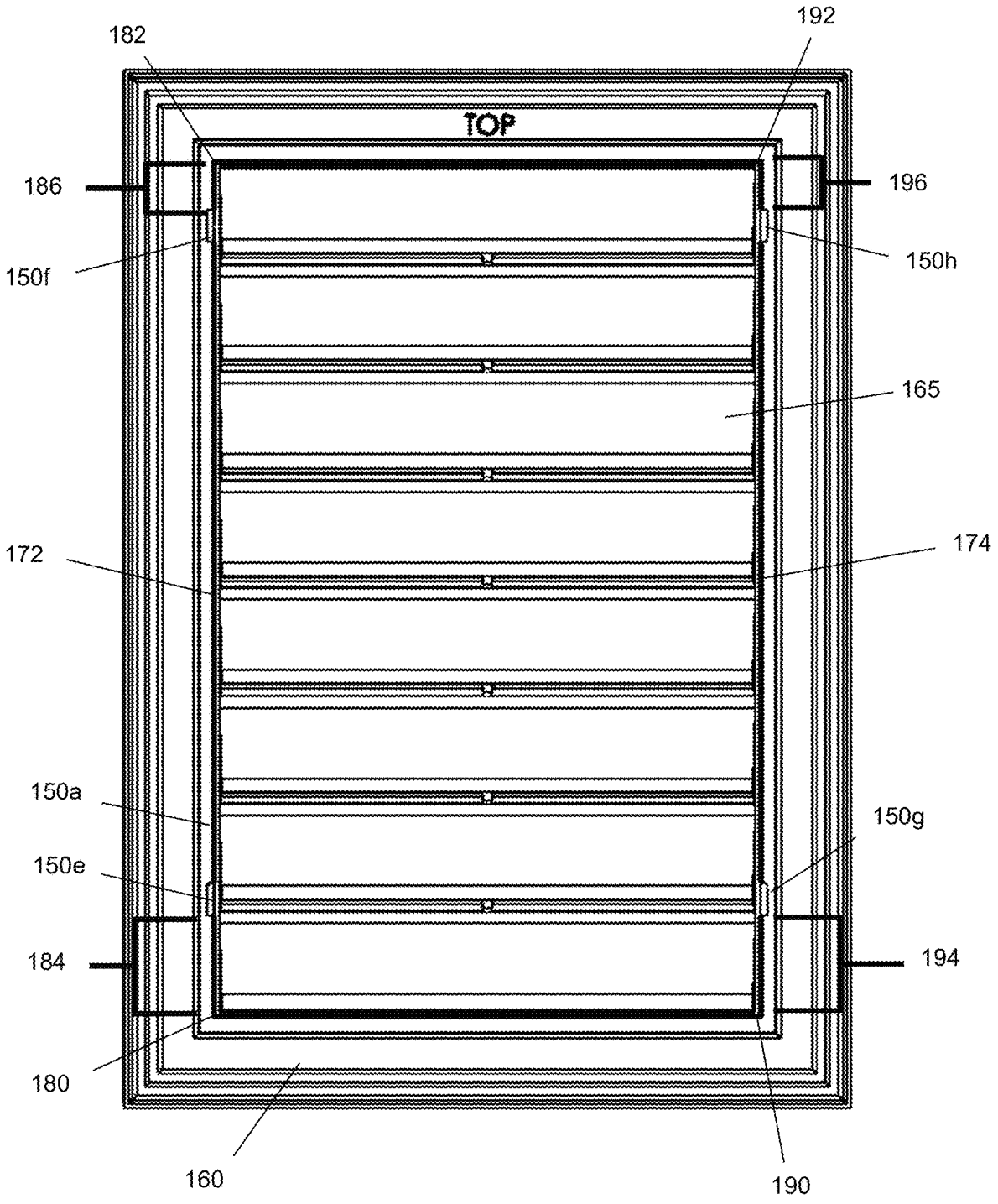
FIG. 6 is a top plan view of a cover of a gable vent assembly in one embodiment of the invention.
Figure 7:
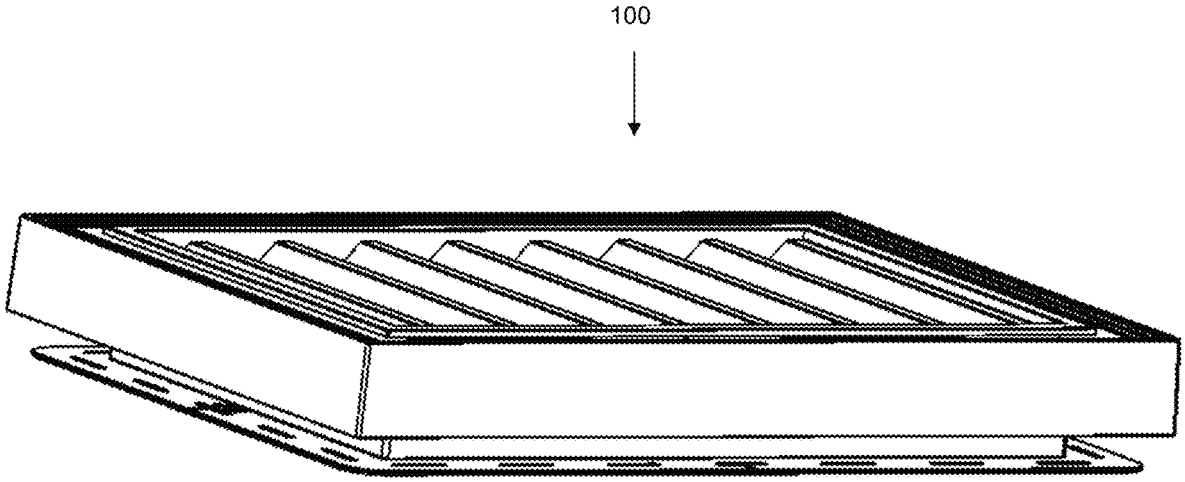
FIG. 7 is a perspective view of a gale vent assembly having a rectangular shape including a base and cover coupled to one another in one embodiment of the invention.

Referring to FIGS. 5 and 6, a cover 160 includes a plurality of vents 165 between a first cover side surface 172 and a second cover side surface 174 opposite the first cover side surface.

The first cover side surface 172 includes a first end 180 of the first cover side surface and a second end 182 of the first cover side surface. The first cover side surface 172 further includes a first cover lock 150*e* located a first cover length 184 from the first end 180 of the first cover side surface and a second cover lock 150*f* located a second cover length 186 from the second end 182 of the first cover side surface. The first cover length 184 has a different measurement from the second cover length 186 to permit rotation or other movement of the cover 160 and base 110 from a mating position of nesting in an unlocked position during packaging, when the locks 150 of the base 110 and cover 160 do not align with one another as shown in FIG. 12, to another mating position of being coupled and locked together during installation, when the locks 150 of the base 110 and cover 160 align with one another as shown in FIG. 11.

The cover 160 includes a second cover side surface 174 opposite the first cover side surface 172. The second cover side surface 174 includes a first end 190 of the second cover side surface and a second end 192 of the second cover side surface, The second cover side surface 174 further includes a third cover lock 150*g* located a third cover length 194 from the first end 190 of the second cover side surface and a fourth cover lock 150*h* located a fourth cover length 196 from the second end 192 of the second cover side surface. The third cover length 194 has a different measurement from the fourth cover length 196 to permit rotation or other movement of the cover 160 and base 110 from a mating position of nesting in an unlocked position during packaging, when the locks 150 of the base 110 and cover 160 do not align with one another as shown in FIG. 12, to another mating position of being coupled and locked together during installation, when the locks 150 of the base 110 and cover 160 align with one another as shown in FIG. 11.

Figure 11:
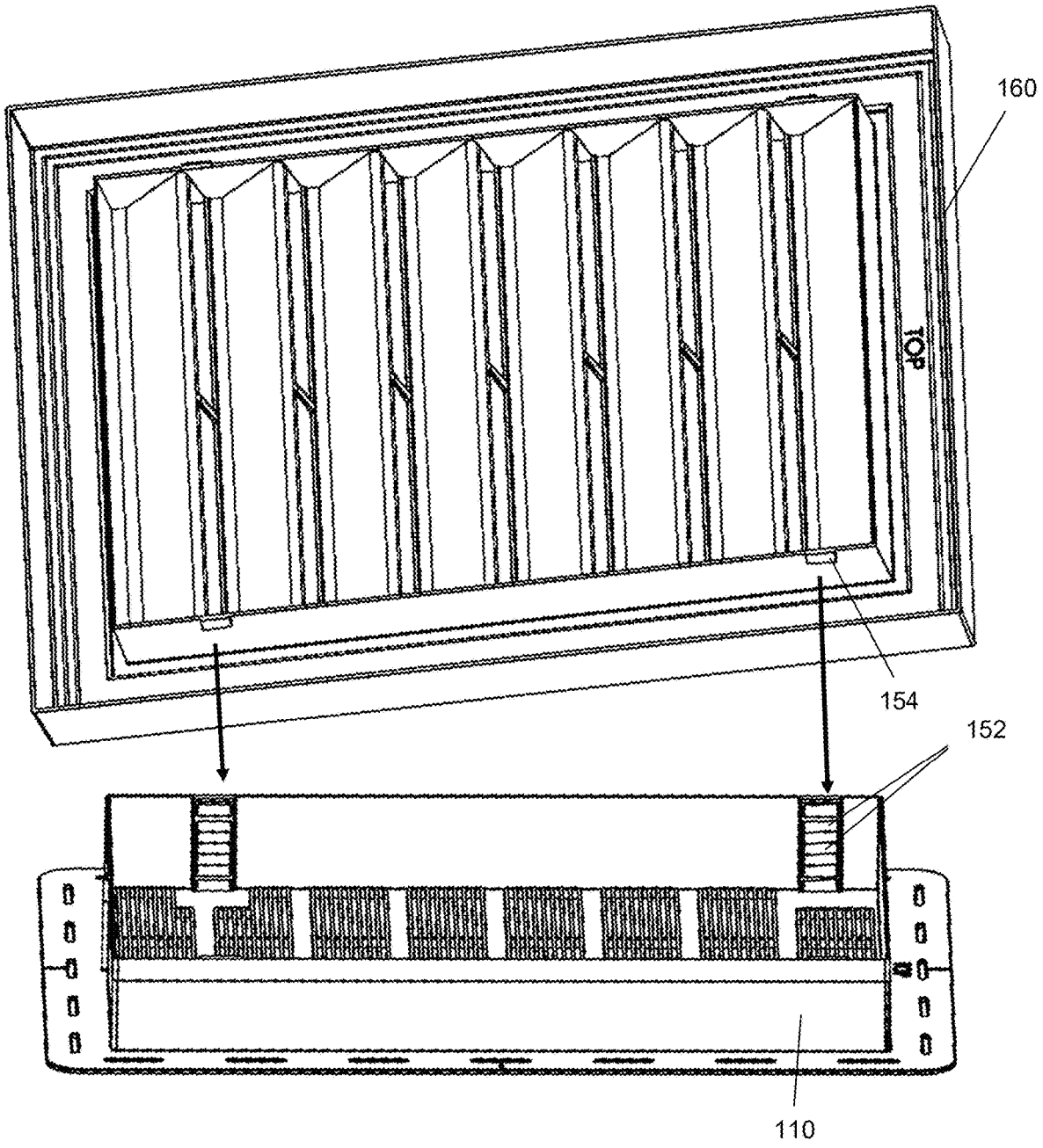
FIG. 11 is an assembly view of a gale vent assembly including a base and cover in a first mating position where locks align with one another to couple and lock the assembly together in one embodiment of the invention.

Referring to FIG. 11, a first mating position between the base 110 and the cover 160 is shown wherein the first base lock couples to the first cover lock, the second base lock couples to second cover lock, the third base lock couples to the third cover lock, and the fourth base lock couples to the fourth cover lock since all of the locks 150 align with one another in the first mating position. In some embodiments, a lock 150 of either the base 110 or the cover 160 may include a plurality of teeth 152 in a row and spaced apart at desired distance that interface with a complementary locking projection 154 so that the cover and base may be distance-adjusted with respect to one another. The ability of the locks to accommodate adjustment of the cover either toward or away from the bottom surface 115 of the base 110 enables the gable assembly to be installed more easily through attic wall having different widths between the interior attic wall that couples to the base 110 and the exterior attic wall where the cover 160 is positioned and couples to the base. In other embodiments of the invention, sliding mechanisms, push button spring clip and hole connections, clips, hook and loop material, spring connectors and like locking mechanisms provide alternative coupling mechanisms for teeth and a locking projection.

Figure 12:
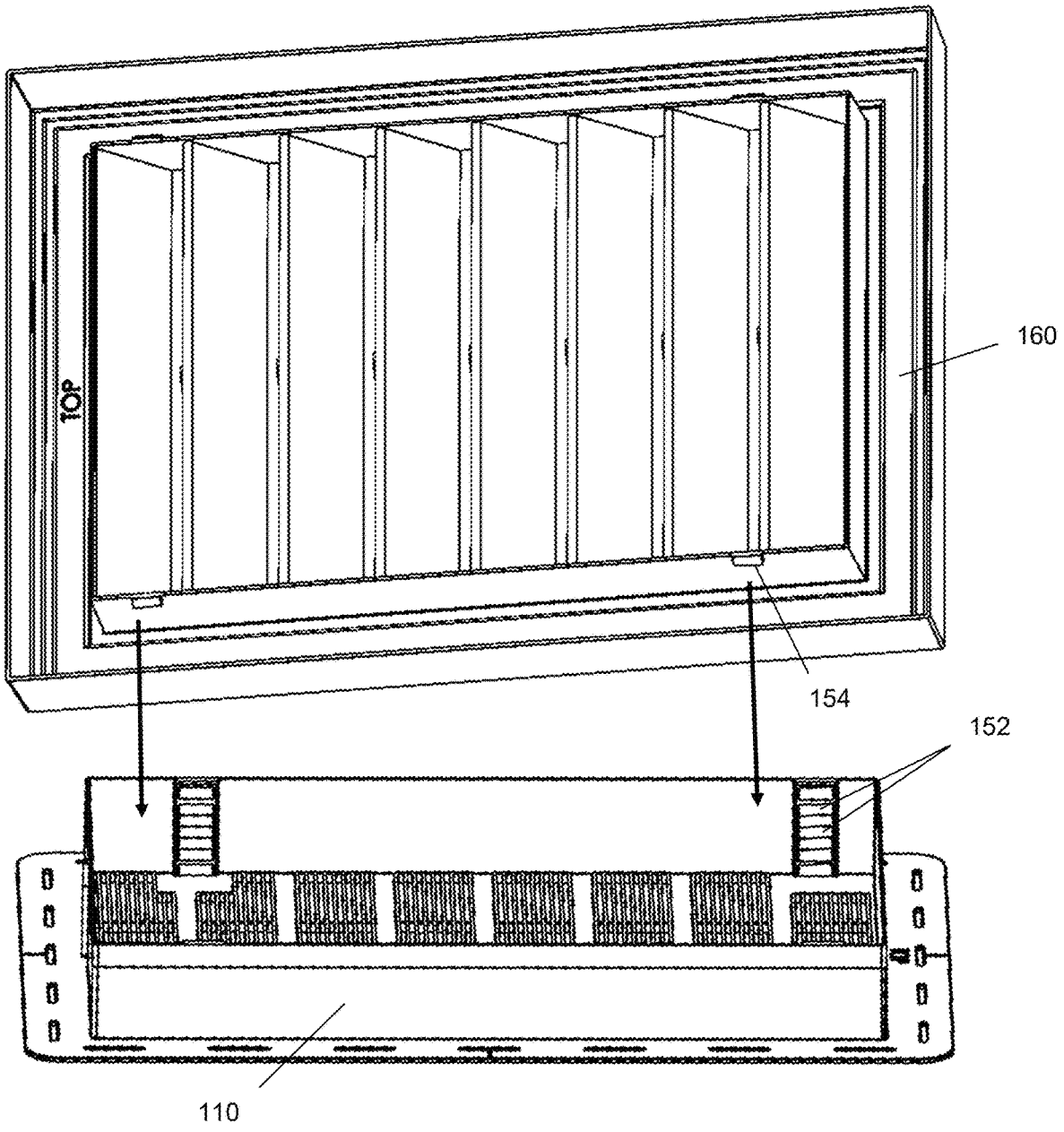
FIG. 12 is an assembly view of a gale vent assembly including a base and cover in a second mating position where locks do not align with one another so that the base and core nest together without locking in one embodiment of the invention.

Referring to FIG. 12, a second mating position is shown wherein the locks 150 of the base 110 and cover 160 do not align and permit the base and cover to be nested together without locking. In one embodiment, the cover 160, while not locked and nested with the base 110, can be rotated 180 degrees from the first mating position shown in FIG. 11 where the locks 150 of the cover 160 and base 110 would align with one another to the second mating position where the locks 150 do not align with another and can advantageously nest, and take up less room, in an unlocked position for storage, transport and shipping until the gable assembly needs to be assembled. When installation of the gable vent assembly is desired, the unlocked base 110 and cover 160 can be easily separated from the nesting position and then rotated to align the locks to couple and lock together the base 110 and cover 160. As described, in some embodiment the locks include distance selection capability between the cover 160 and the bottom surface 115 of the base 110, such as with locking teeth 152 (shown on the base 110, but could alternatively be included on the cover 160) and a locking projection 154 (shown on the cover 160, but could alternatively be included on the base 110).

Figure 8:
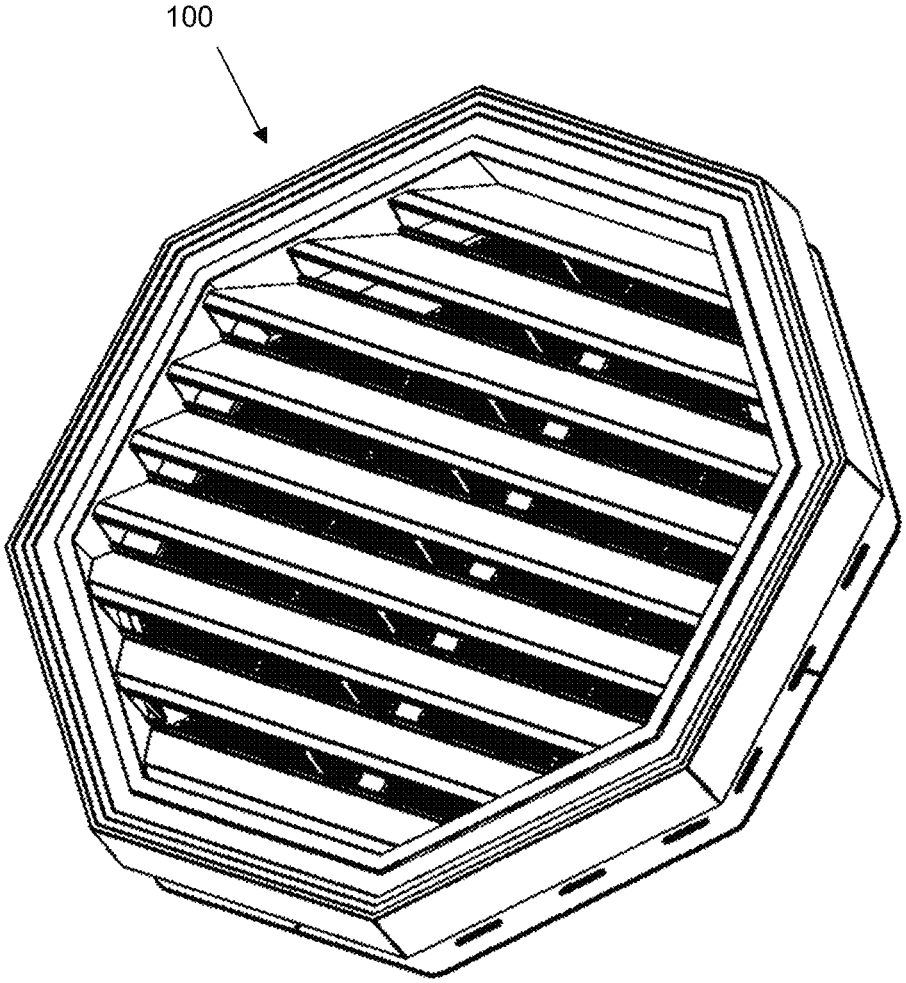
FIG. 8 is a perspective view of a gale vent assembly having an octagonal shape including a base and cover coupled to one another in one embodiment of the invention.
Figure 9:
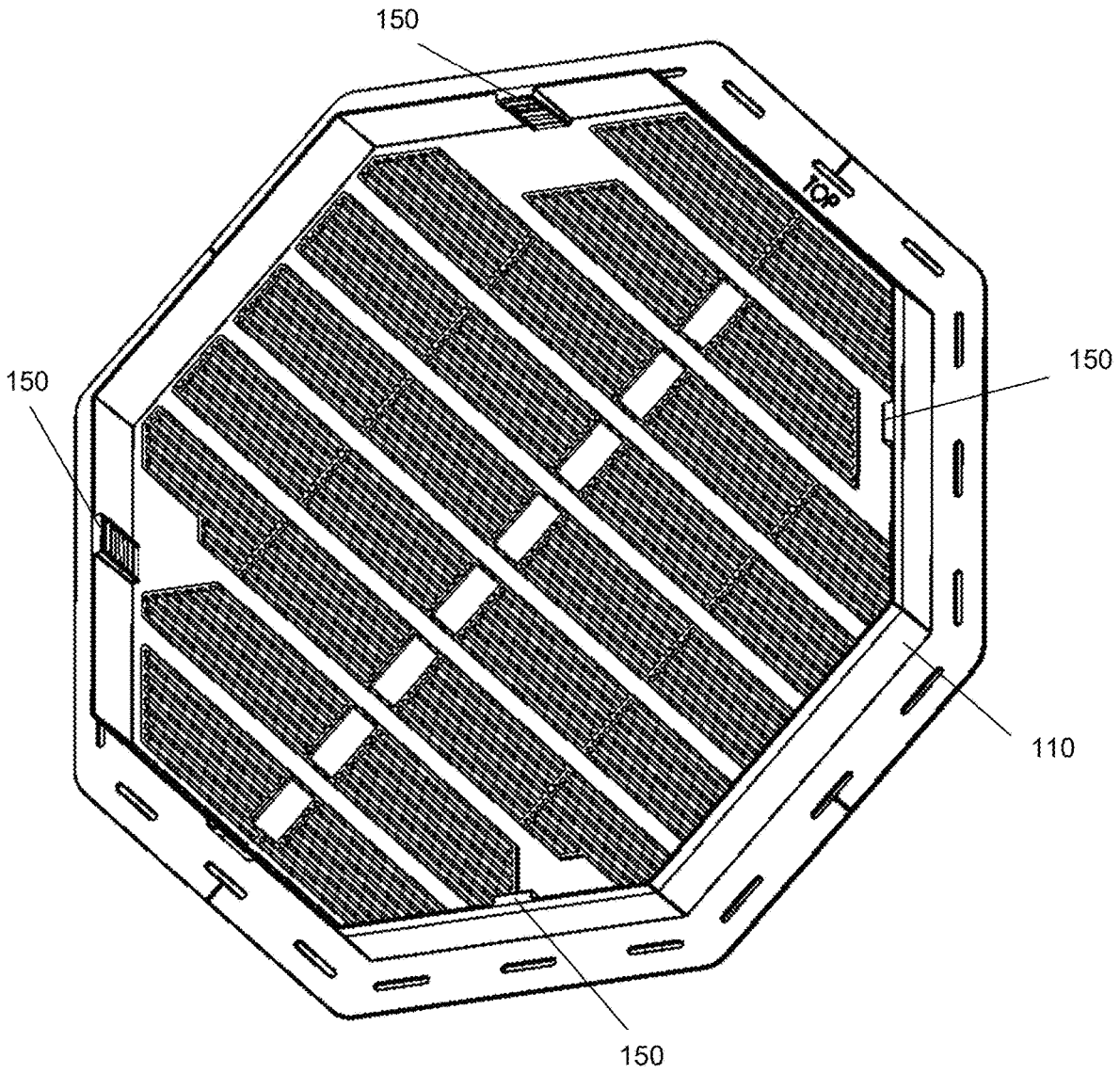
FIG. 9 is a perspective view from above of a top of a base of a gable vent assembly having an octagonal shape in one embodiment of the invention.
Figure 10:
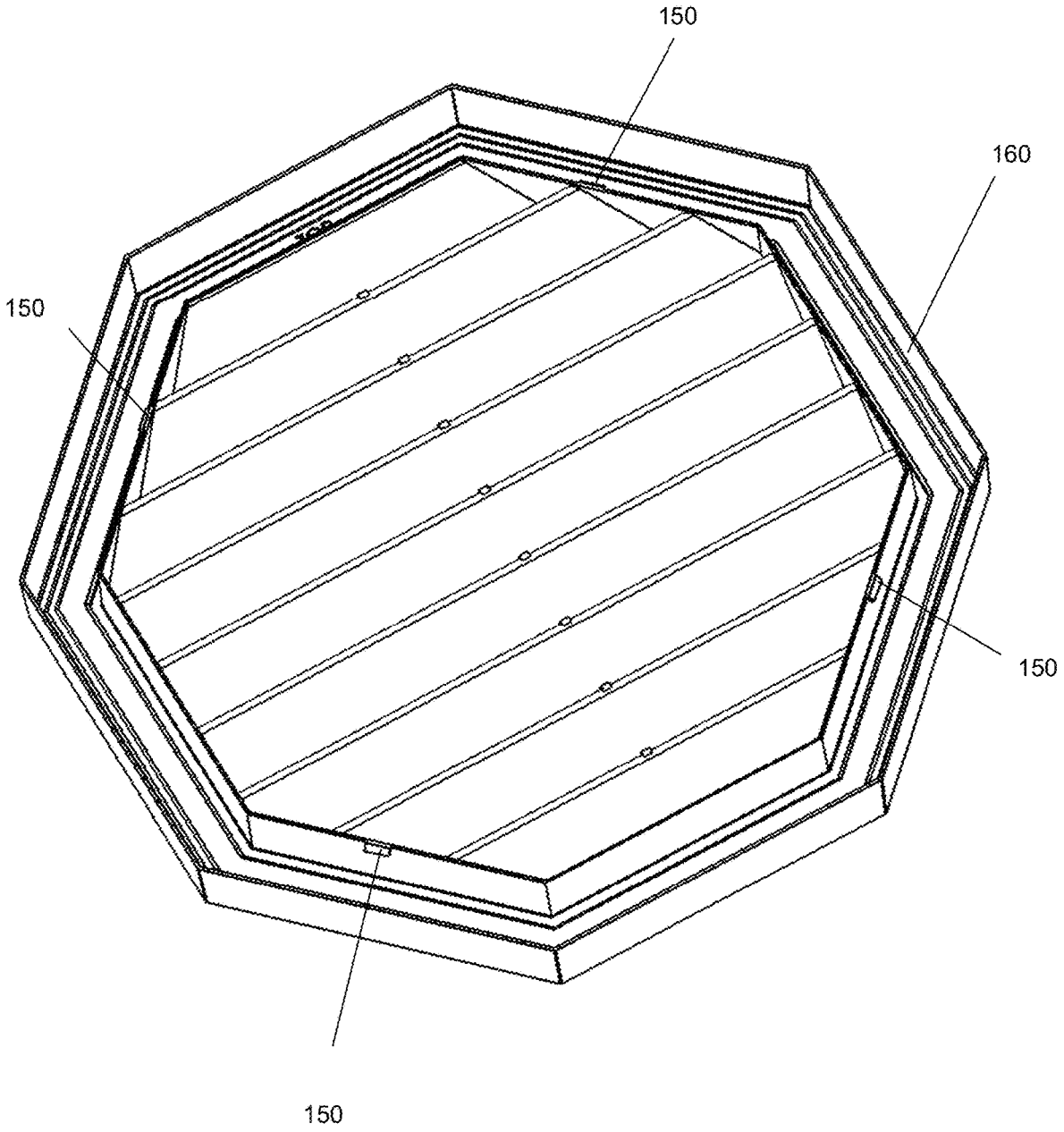
FIG. 10 is a perspective view from above of a top of a cover of a gable vent assembly having an octagonal shape in one embodiment of the invention.

Referring to FIGS. 8-10, an alternative embodiment of a gable vent assembly 100 is shown having an octagonal shape. In the depicted embodiment, multiple side surfaces of both the base 110 and cover 160 may each include at least one lock 150. It will be appreciated that rotation of the cover 160 or base 110, wherein both have an octagonal shape, permit a base 110 to mate with a cover 160 in both locked and unlocked nesting positions, since the locks 150 of base 110 (FIG. 9) can be aligned with the locks 150 of cover 160 (FIG. 10) for coupling and locking or the base 110 or cover 160 can be rotated so that a surface of a cover 160 with a lock will abut a surface of the base 110 without a lock and allow nesting without alignment an locking together of the locks 150.

Various embodiments of the invention have been described. It will, however, be evident that various modifications and changes may be made thereto, and additional embodiments may be implemented, without departing from the broader scope of the invention disclosed herein. This specification is to be regarded in an illustrative rather than a restrictive sense.

What is claimed is:

1. A gable vent assembly comprising:

a base including a bottom surface with a plurality of openings;

a first base side surface extending outward from the bottom surface, wherein the first base side surface includes a first end of the first base side surface and a second end of the first base side surface, and wherein the first base side surface further includes a first base lock located a first base length from the first end of the first base side surface and a second base lock located a second base length from the second end of the first base side surface, and wherein the first base length has a different measurement from the second base length;

a second base side surface opposite the first base side surface extending outward from the bottom surface, wherein the second base side surface includes a first end of the second base side surface and second end of the second base side surface and wherein the second base side surface further includes a third base lock located a third base length from the first end of the second base side surface and a fourth base lock located a fourth base length from the second end of the second base side surface, and wherein the third base length has a different measurement from the fourth base length;

a cover including a plurality of vents between a first cover side surface and a second cover side surface opposite the first cover side surface, wherein the first cover side surface includes a first end of the first cover side surface and a second end of the first cover side surface, and wherein the first cover side surface further includes a first cover lock located a first cover length from the first end of the first cover side surface and a second cover lock located a second cover length from the second end of the first cover side surface, and wherein the first cover length has a different measurement from the second cover length;

a second cover side surface opposite the first cover side surface, wherein the second cover side surface includes a first end of the second cover side surface and a second end of the second cover side surface, and wherein the second cover side surface further includes a third cover lock located a third cover length from the first end of the second cover side surface and a fourth cover lock located a fourth cover length from the second end of the second cover side surface, and wherein the third cover length has a different measurement from the fourth cover length;

in a first mating position between the base and the cover, the first base lock couples to the first cover lock, the second base lock couples to second cover lock, the third base lock couples to the third cover lock, and the fourth base lock couples to the fourth cover lock; and wherein in a second mating position with the cover rotated 180 degrees from the first mating position, the base and the cover nest together without any of the locks coupling to one another.

2. The gable vent assembly of claim 1, wherein the locks that couple together are configured to secure together to provide adjustable distance between the bottom surface of the base and the plurality of vents of the cover.

3. The gable vent assembly of claim 2, wherein at least one lock of a pair of locks that couple together include locking teeth.

4. The gable vent assembly of claim 3, wherein at least one lock of a pair of locks that couple together includes a locking projection that engage the locking teeth of the other lock of the pair of locks.

5. The gable vent assembly of claim 4, wherein the cover is a rectangle or square.

6. The gable vent assembly of claim 3, wherein the cover is a rectangle or square.

7. The gable vent assembly of claim 2, wherein the cover is a rectangle or square.

8. The gable vent assembly of claim 1, wherein the cover is a rectangle or square.

* * * * *